US005188239A

United States Patent [19]

Stowe

[11] Patent Number: 5,188,239

[45] Date of Patent: Feb. 23, 1993

[54] TRAMP METAL SEPARATION DEVICE

[75] Inventor: Michael W. Stowe, Boyne City, Mich.

[73] Assignee: Industrial Magnetics, Inc., Boyne City, Mich.

[21] Appl. No.: 716,049

[22] Filed: Jun. 17, 1991

[51] Int. Cl.[5] ..... B03C 1/00

[52] U.S. Cl. ..... 209/223.1; 209/229; 210/222

[58] Field of Search ..... 209/217, 223.1, 228, 209/229, 231, 636; 210/222, 223; 277/228

[56] References Cited

U.S. PATENT DOCUMENTS

| | | | |
|---|---|---|---|
| Re. 24,478 | 5/1958 | Kilbourne | 277/228 |
| 2,912,106 | 11/1959 | Martin | 209/223.1 |
| 2,992,735 | 7/1961 | Troy | 209/223.1 |
| 3,630,352 | 12/1971 | Morse | 209/223.1 |
| 4,394,264 | 7/1983 | Schimion et al. | 209/229 |
| 4,457,838 | 7/1984 | Carr | 209/229 |
| 4,620,923 | 11/1986 | Meister | 209/223.1 |
| 4,867,869 | 9/1989 | Barrett | 209/228 |
| 5,043,063 | 8/1991 | Latimer | 210/222 |
| 5,066,390 | 11/1991 | Rhodes et al. | 209/229 |

*Primary Examiner*—Joseph E. Valenza
*Attorney, Agent, or Firm*—Krass & Young

[57] ABSTRACT

A tramp metal separation device adapted to be removably inserted into a housing which directs pelletized raw material to an industrial machine and to separate tramp metal contaminants therefrom. A drawer frame having an outer face plate with a plurality of openings disposed therethrough is adapted to be removably inserted into the housing. A plurality of cylindrical magnets adapted to be inserted through the plurality of openings in the outer face plate are secured to a drawer plate. In one embodiment of the present invention, the at least one silicon-based O-ring disposed in a groove in on of the plates so as to form an air tight seal between the face plate and the magnetic drawer. Additionally, a plurality of silicon-based O-rings may be disposed in grooves on the inner surface of the openings so as to form a wiper mechanism to aid in removing particles from the magnets.

16 Claims, 2 Drawing Sheets

TRAMP METAL SEPARATION DEVICE

FIELD OF THE INVENTION

The present invention relates to devices for removing tramp metal from a granular raw material, such as is used in plastic injection molding, grain storage, pharmaceutical handling, or other granular product feeding apparatus.

BACKGROUND OF THE INVENTION

There are many devices which store or further process a supply of granular material in an industrial environment. Many devices, such as grain storage apparatus or pharmaceutical handling apparatus, are designed to simply direct a supply of granular material to containers for storage. Other devices, such as a variety of industrial fabricating devices, process the material to form a component therefrom. For example, a plastic injection molding machine typically accepts a supply of pelletized plastic material, melts the pellets, injects the resulting liquid plastic into a mold, and discharges a molded part after the part has formed and cooled.

The prior art with respect to devices which handle granular materials is best described by continuing the example with respect to a product-forming machine. In the past, it has been common to use an overhead hopper for feeding the granular pellets of raw material to the product-forming machines. A quantity of pellets is placed in a very large container, such as a self-contained feed hopper, positioned above and adjacent to the machine. This arrangement permits the pellets to be gravity fed continuously into the molding machine.

In this arrangement, all of the raw material in the overhead storage container is directed to the molding machine. Frequently, the supply of raw material includes unwanted microscopic foreign metal material or foreign metal bodies, in the form of metal fragments, screws, washers, or the like. Such unwanted metallic foreign contaminants are referred to as "tramp metals" in the industry. These contaminants may be found in the plastic materials as it comes from the manufacturer due to wear or flaws in the manufacturer's transportation, manufacturing, packaging or conveying machinery. Other metal contaminants may be introduced into the raw materials from operations associated with handling the material at the end manufacturing facility itself. In addition, the growing use of recycled plastic materials for molding purposes increases the frequency of contaminant occurrences in the raw material supplies. The process of reclaiming the recyclable plastics often results in unwanted metallic contaminants becoming intermixed with the recovered plastics as a result of poor separation techniques at material recycling facilities. Frequently, recycling houses process recyclable plastics by chopping them into pieces of suitable size for reuse in molding apparatus. These plastic pieces may contain minute metal contaminants, as well as imbedded metal brackets, screws, nuts, and so on.

The presence of these metallic contaminants in the raw materials being processed in product-forming machines is undesirable for a variety of reasons. Contaminants may actually damage an industrial machine or render the finished part unusable. Even if the part is properly formed, the customer may object to the presence of metal therein as it may cause unacceptable structural, visual, or magnetic aberrations in the finished part.

Magnetic separators have been installed at the feed side of such industrial processing equipment to insure that metallic contaminants are removed. A magnetic separator typically comprises a housing component which acts as an intermediate hopper adapted to be placed above the forming machinery for the infeed of raw materials. A plurality of magnets form a magnetic drawer adapted to be removably inserted and secured in place in the feed path of this housing. As the granular material feeds through the housing, the metallic particles are attracted to the magnets. Periodically, the drawer is removed and the metallic materials are physically cleared from the magnets. The drawer is then reinserted into the housing for additional service.

Existing separator systems typically seal the mating surfaces between the housing and the separator drawer with an open cell foam gasket. The punishing environment in which this equipment operates results in rapid deterioration of such gasket materials. This deterioration turns the gasket itself into a contaminant which may enter the housing, and ultimately, contaminates the material being processed.

Further, overhead hopper configurations have recently fallen out of favor because of the difficulties encountered in changing the overhead supply hopper when a change in raw material composition is needed. The hoppers are difficult to transport and manipulate since they may weigh several hundred pounds when loaded with raw material. To overcome these problems with overhead or gravity feed hopper systems, a vacuum-feed system has been developed to supply the raw granular material from a container disposed adjacent to the processing machine. Materials are drawn from the container by operation of a vacuum applied thereto and fed into the processing machine. Materials can be changed by merely redirecting the vacuum between supply containers at ground level.

In this new vacuum-feed environment, metallic foreign matter is quite easily drawn into the processing equipment with the raw material, making the use of a separator a virtual necessity. However, the open cell foam gaskets of conventional magnetic separators provide a very poor seal which prevents the machinery from operating properly in a vacuum fed manner.

Therefore, a need exists for a magnetic tramp metal separator for removing tramp metal from equipment utilizing non-metallic granular materials which resists deterioration during use and may be used with vacuum feed equipment. This need exists with respect to product-forming machines, granular handling equipment, and most other devices which handle granular materials.

SUMMARY OF THE INVENTION

The present invention provides an improved tramp metal separation device adapted to direct granular raw material, such as pelletized plastic material, to an industrial machine or other destination. The tramp metal separation device generally comprises two components: the housing and the magnetic drawer which is adapted to be removably inserted into the housing.

The housing is generally formed as a hollow metal structure having openings at either end to allow the passage of granular material therethrough. A side opening provides access to the internal chamber of the housing so that the magnetic drawer may be inserted therethrough.

The magnetic drawer includes a drawer frame and a plurality of magnetic rods secured thereon. The magnetic drawer frame is adapted to be removably inserted into the housing. The magnets are secured to the drawer frame so as to extend into the housing when the drawer is inserted therein. The entire drawer assembly can be removed and the magnets wiped clean of particles.

Preferably, the drawer includes a face plate which is sized so as to sealably engage the exterior of the housing. These two components are configured to provide a sufficient area of overlap for proper sealing. Sealing is accomplished by the use of a silicon-based gasket disposed in a groove in either the housing or the face plate and compressed between the face plate and the housing. The silicon material resists deterioration and provides a proper sealing means for vacuum-fed machines. Further, the grooves serve to precisely position the gasket between the components and protects a portion of the gasket from the operating environment.

In the most preferred embodiment, the magnetic drawer is configured to provide an automatic magnet wiping mechanism for use in removing the foreign particles from the magnets. In this embodiment, the face plate is attached to a support bracket configured according to the dimensions required by the particular application and housing. The face plate further includes a plurality of openings having a corresponding plurality of silicon-based O-rings disposed about the inner surface of the openings. The magnetic rods are secured to a drawer plate so as to extend substantially perpendicularly away from one side thereof in a spaced apart relation to one another and are inserted through the openings so that the O-rings form a wiper gasket around the magnetic rods. These rings wipe the magnets clean of contaminants during relative movement of the face plate and the magnets in subsequent cleaning operations.

Preferably, the external plates of the magnetic drawer are formed of a transparent material to allow visual verification of the flow of the raw material through the housing and the amount of foreign metal objects collected by the magnets. This feature is preferred whether the magnetic drawer is configured as a rigid system or as sections capable of moving relative one another for cleaning purposes as previously described. In the wiper mechanism configuration, both the face plate and the drawer plate would be transparent.

The magnets are preferably formed from various materials depending on the specific application or use intended. For example, a magnetic ceramic material may be used for a variety of applications since such materials are relatively inexpensive and have good magnetic properties for trapping both small and large metallic foreign matter. For high heat applications, an alnico magnetic material is better suited to an elevated temperature environment. Further, where it is crucial to separate even relatively small foreign particles from the raw material a magnetic neodymium material, such as a neodymium-iron-boron composition, should be used to produce a stronger magnetic field capable of attracting small particles.

To facilitate attachment of the magnets to the drawer plate, the magnets are formed of a suitable magnetic material pressed into a hollow, thin-walled, cylindrical, stainless steel casing. The stainless steel casing protects the magnetic inner core from damage and allows for relatively easy attachment of the magnets to the drawer plate, while not interfering with the magnetic properties of the inner magnetic core.

BRIEF DESCRIPTION OF THE DRAWINGS

These and other objects and aspects of the invention will become apparent in the detailed description of the invention hereinafter with respect to the drawings in which.

DETAILED DESCRIPTION OF THE PREFERRED EMBODIMENT

Figures 1, 4:
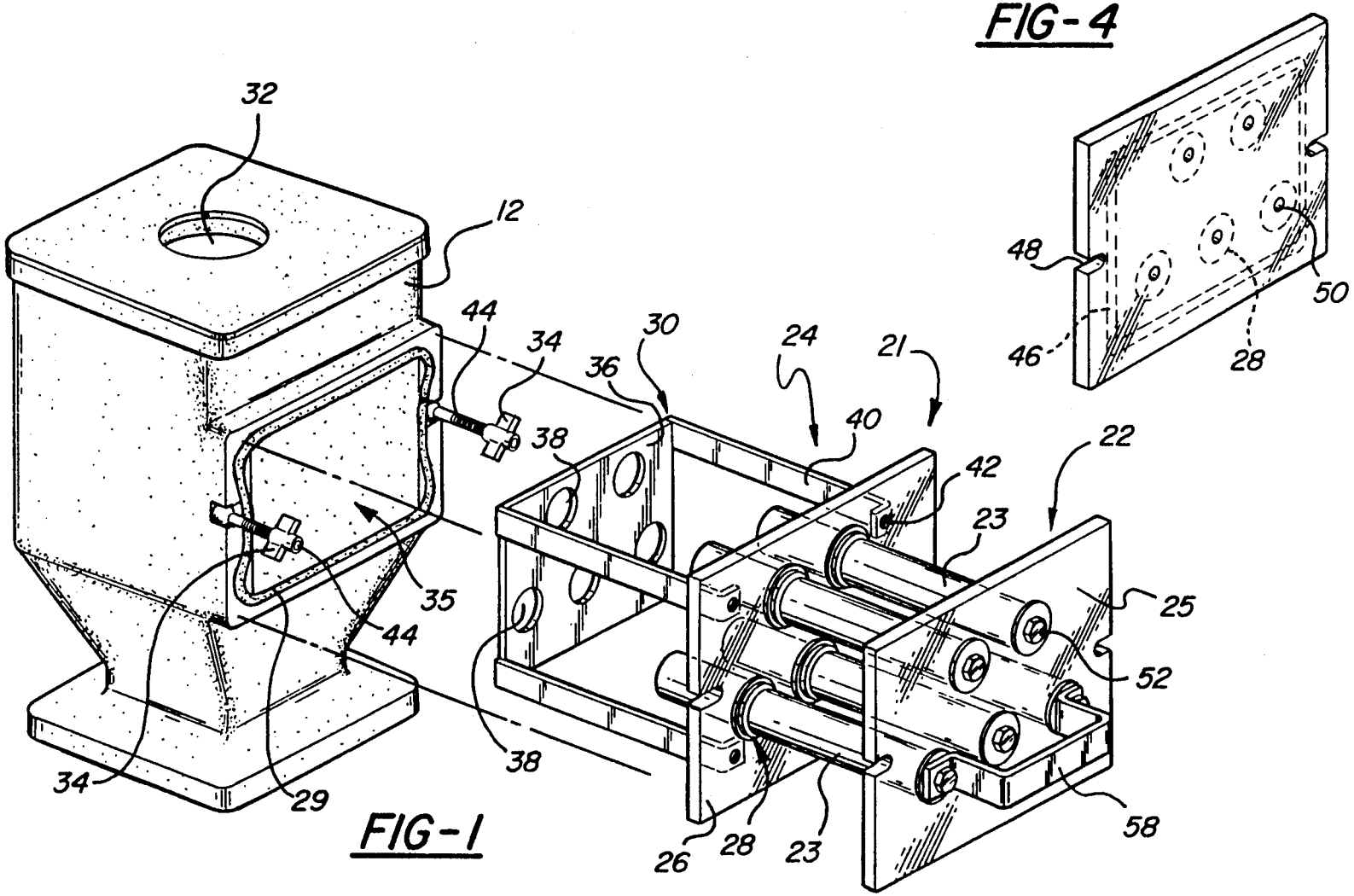
FIG. 1 is an exploded perspective view of the invention tramp metal separator.
FIG. 4 is a diagram of the face and drawer plates according to the present invention showing the aspects of an alternative embodiment of the face plate in dashed lines and the aspects of the drawer plate in solid lines.
Figure 2:
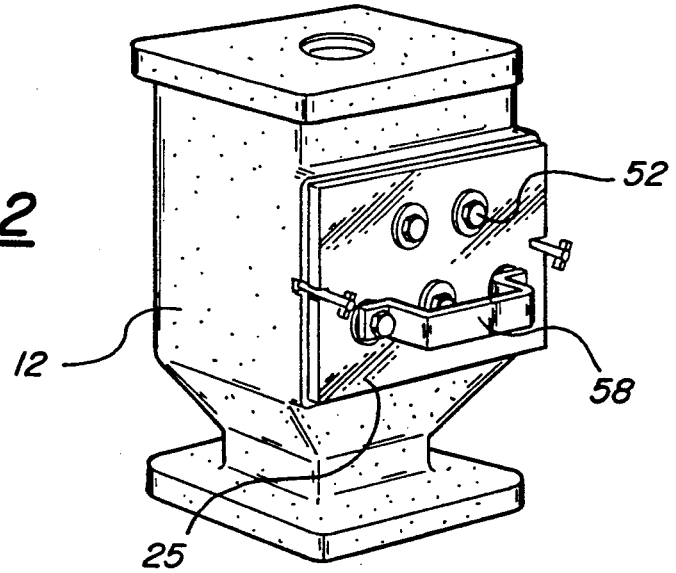
FIG. 2 is an assembled perspective view of the invention tramp metal separator.
Figure 5:
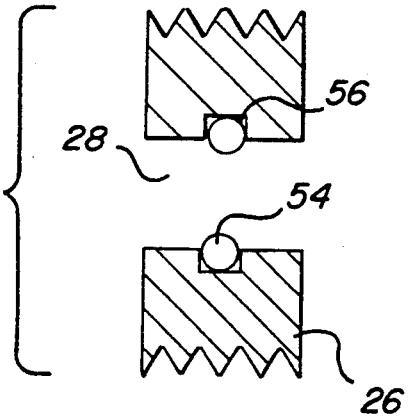
FIG. 5 is a cutaway section of one opening in the face plate.
Figure 3:
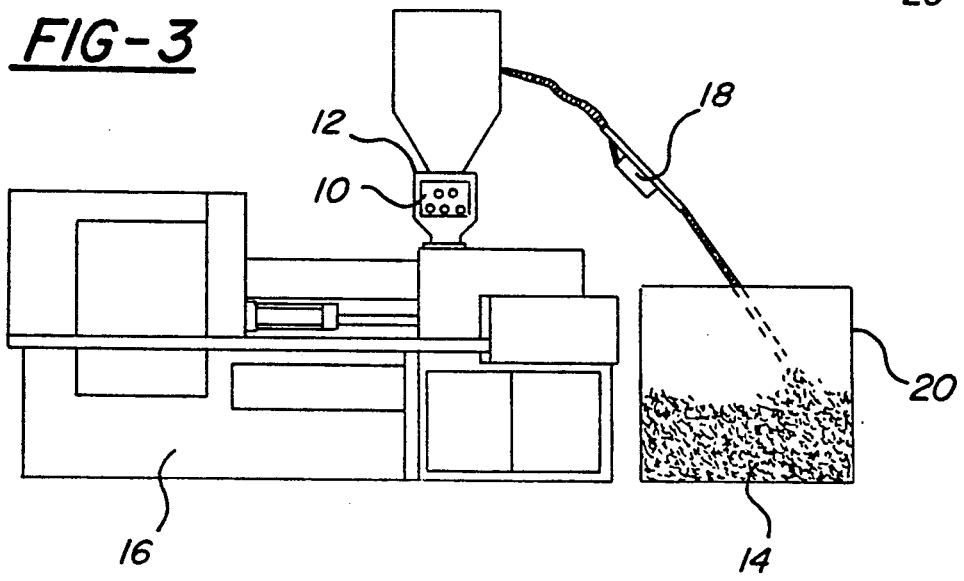
FIG. 3 is a line diagram of the present invention disposed on a vacuum fed molding machine.

Continuing with the example of a product molding apparatus and with reference to FIG. 3, the present invention provides a tramp metal separation device 10 having a housing 12 which directs pelletized raw plastic material 14 to an industrial fabrication machine 16. For example, the housing 12 may be positioned between the vacuum feed system 18 and the fabrication machine 16 so that the separation device 10 can remove tramp metal contaminants from the pelletized plastic material 14 drawn into the system from container 20.

With reference also to the remaining figures, the present invention generally comprises a magnetic drawer 21 adapted to fit into the housing 12 disposed on the fabrication device 16. The drawer 21 is formed of a magnet unit 22 and a drawer frame 24. The drawer frame 24 has an outer face plate 26 which defines a plurality of openings 28 therethrough. A thin metal support bracket 30 is secured to the face plate 26 to form the drawer frame 24. The magnet unit 22 incorporates a plurality of cylindrical magnets 23 secured to a drawer plate 25 so as to extend from one side thereof and adapted to be inserted through the plurality of openings in the outer face plate 26 of the drawer frame 24.

More specifically, the housing 12 acts as an intermediate hopper for the raw materials 14 which are being processed by the fabrication machine 16. Pelletized plastic material 14 is fed into the opening 32 in the top of the housing 12, and exits the housing from the opening (not shown) in the bottom thereof. A plurality of clamping devices 34 are mounted adjacent to a side opening 35. The magnetic drawer 21 can thus be inserted into the housing 12 through the side opening 35 and secured in place by operation of the clamping devices 34.

The housing 12 is formed from cast ductile iron so as to be very rugged and heat-resistant, inasmuch as the radiant heat from an adjacent piece of industrial equipment may cause the hopper temperature to exceed 200° F. The high vibration environment typically associated with industrial molding equipment also dictates the rugged construction of this device.

The drawer frame 24 generally includes the face plate 26 and the magnet support bracket 30. The bracket 30 is formed of stainless steel which is configured to provide a planar base portion 36 having a plurality of openings 38 therein and four leg members 40 extending substantially perpendicularly from the base 36. The leg members 40 are secured to the face plate 26 by operation of suitable fasteners 42 so as to dispose the base portion 36 generally apart from and parallel to the face plate 26. Together, the bracket 30 and the face plate 26 cooperate to form the drawer frame 24 which has a large inner area void of obstructions to allow for the positioning of magnets 23 therein and the flow of material therethrough. The openings 38 in the base of the "4-legged" bracket 30 are thus positioned relative the openings 28 in face plate 26 and are adapted to support the free end of the magnetic cylinders 23 when the device is secured in place.

The face plate 26 of the drawer frame 24 is sized so as to sealably engage the exterior of the housing 12, such as by a silicon-based gasket 29. In typical applications, this gasket 29 is formed of "O" ring material having a 3/16 inch diameter and 70 durometer hardness. The silicon material resists deformation due to the operating environment and provides sufficient sealing for vacuum-fed environments.

The gasket 29 is preferably secured within a groove machined in the housing 12 about the side opening 35. The groove is machined to a depth of approximately ½ to ⅔ the diameter of the gasket. The gasket 29 is compressed between the face plate 26 and the housing 12 by operation of clamping devices 34 threaded on screw means 44. Since, these two components do not move relative one another, they can be configured to provide a sufficient area of overlap for proper sealing. It should be understood that the length of the gasket 29 depends entirely upon the dimensions of the side opening 35 to be sealed.

An alternative method of securing the gasket 29 would be to machine a like dimensioned groove 46 outboard of the openings in the inboard side of the face plate 26. The gasket can then seal the interface between the face plate and the housing when assembled. In either method, the groove serves to protect a portion of the gasket from direct exposure to the operating environment. Further, the groove allows precise positioning of the gasket between the components.

The plurality of magnets 34 are formed as solid cylinders. A like number of stainless steel hollow cylinders, having a wall thickness of approximately one-sixteenth of an inch, are provided as containers for the magnets. The magnetic cylinders 34 are press fit into the stainless steel cylinders. Stainless steel is used throughout the magnetic drawer assembly (including the bracket 30 and fasteners), since it is non-magnetic and does not interfere with the magnetic fields generated by the internal magnets. The stainless steel cylinders also provide a mechanical protection to the magnets, which can be quite soft, brittle and subject to breakage. Lastly, the stainless steel cylinders provide a base for the fasteners 52 to engage in securing the magnets 34 on the drawer plate 25.

The core of the magnets 23 is preferably formed from different materials depending on the applications intended. For example, a magnetic ceramic material may be used for a variety of applications since such materials are relatively inexpensive and have good magnetic properties for trapping both small and large metallic foreign matter. However, for high heat applications am alnico magnetic material is better suited to handle the elevated temperature environment. Further, where it is crucial to separate even relatively small foreign particles from the plastic material a magnetic neodymium material, such as a neodymium-iron-boron composition, should be used to produce a stronger magnetic field.

A plurality of silicon-based O-rings are disposed so as to form a wiper mechanism about each magnet. The plurality of silicon-based O-rings 54 correspond in number to the plurality of openings 28 in the face plate 26; each being disposed in a groove 56 on the inner surface of a respective opening 28 so as to form a wiper seal between the face plate 26 and each of the magnets 23 associated with the magnetic drawer.

In use, the magnetic drawer frame 24 is inserted into the housing 12 through side opening 35, the magnetic drawer 21 is fitted onto the drawer frame 24 (i.e., the magnets are inserted through the openings in the face plate), and the entire drawer assembly is secured in place with the two opposed thumb screw clamping devices 34 bearing on the outer surface of the assembly. As the material is fed through the housing 12, magnetic particles are attracted to the cylinders, and collect there until it is time for cleaning. At cleaning time, the drawer assembly is removed and taken to a cleaning location. A handle 58 on the outer drawer plate 25, to which the magnetic cylinders are mounted, allows the drawer 21 to be easily separated from the inner face plate 26. The O-rings effectively act as wiper gaskets to wipe the magnetic materials attracted to the magnets from the cylinders. Accordingly, the metallic material falls away from the cylinders as they are moved relative the face plate 26.

It should be readily apparent that the face plate 26 and drawer plate 25 are substantially identical in exterior size and shape. Each have notches 48 for the clamping devices 34. However, the drawer plate has small openings 50 for passage of fasteners 52 to secure the magnets in place, while the face plate 26 has larger openings 28 similarly disposed for passage of the magnets therethrough.

Preferably, the face plate and the drawer plate are formed of a transparent material, such as lexan, so as to allow visual verification of the flow of plastic material through the housing 12 and the extent of foreign metal objects trapped by the magnets 23.

Five magnetic cylinders are disclosed in the drawings hereto; however, it should be readily apparent that any number of magnets can be used without departing from the scope of the invention herein. Further, such magnets can be disposed in patterns other than are disclosed herein depending on the dimensions of the particular application. It should also be apparent that the present invention can be utilized in a fixed drawer as opposed to the slidable, wiper mechanism embodiment herein described. Further, it should be apparent that, even though the invention has been described with respect to the product-forming machines, the invention can be utilized in any machine which manipulates granular materials.

From the foregoing description of the preferred embodiment it can be seen that various alternative embodiments of the invention can be anticipated without departure from the scope of the invention as defined in the following claims.

I now claim:

1. An improved removable tramp metal separation device adapted to be removably inserted through a side opening of a housing which directs granular raw material therethrough and to separate tramp metal contaminants therefrom, the improvement comprising said device being formed of a drawer frame having wiper means and a magnet unit, slidably interconnected such that upon removal of the device from the housing the drawer frame can slide relative to the magnet unit to wipe tramp metal from the surface thereof.

2. The device of claim 1, wherein said drawer frame including an outer face plate having a plurality of openings therein; and said magnet unit is formed from a plurality of cylindrical magnets secured to a drawer plate so as to extend substantially perpendicularly away from one side of said drawer plate, said plurality of cylindrical magnets being adapted to be inserted through said plurality of openings in said outer face plate.

3. The device of claim 2, wherein said wiper means comprises a plurality of silicon-based O-rings corresponding in number to said plurality of openings in said face plate are disposed in a respective groove on the surface of said openings in said face plate so that said magnet unit can slidably engage said drawer frame such that upon removal of the device from the housing, the drawer frame can slide relative to the magnet unit to wipe tramp metal from the surface thereof.

4. A removable tramp metal separation device adapted to be removably inserted into a housing which directs granular raw material therethrough and to separate tramp metal contaminants therefrom, comprising:

a drawer frame adapted to be removably inserted into said housing, said drawer frame including an outer face plate having a plurality of openings therein;

a magnet unit formed from a plurality of cylindrical magnets secured to a drawer plate so as to extend substantially perpendicularly away from one side of said drawer plate, said plurality of cylindrical magnets being adapted to be inserted through said plurality of openings in said outer face plate; and a plurality of silicon-based O-rings corresponding in number to said plurality of openings in said face plate are disposed in a respective groove on the surface of said openings so that said magnet unit can slidably engage said drawer frame such that upon removal of the device from the housing, the drawer frame can slide relative to the magnet unit to wipe tramp metal from the surface thereof.

5. The device of claim 4, wherein said magnets are at least partially formed from a ceramic material.

6. The device of claim 4, wherein said magnets are at least partially formed from a alnico material.

7. The device of claim 4, wherein said magnets are at least partially formed from a rare earth neodymium material.

8. The device of claim 4, wherein said magnets are formed of a magnetic material pressed into a hollow cylindrical stainless steel casing.

9. The device of claim 4, wherein said face plate and said drawer plate are at least partially formed of a transparent material.

10. A tramp metal separation device for use separating tramp metal contaminants from pelletized raw material in industrial machines, comprising:

a housing adapted to receive pelletized plastic material and direct said pelletized material on to an industrial fabrication machine;

a drawer frame adapted to be removably inserted into said housing, said drawer frame including an outer face plate having a plurality of openings therein, the surface of each of said openings having a groove disposed therein;

a silicon-based gasket operative to provide an air tight seal between said drawer frame and said housing when said device is assembled;

a plurality of silicon-based O-rings corresponding in number to said plurality of openings, each of said O-rings being disposed in the groove of one of said openings;

a drawer plate; and a plurality of cylindrical magnets corresponding in number to said plurality of openings in said outer face plate of said drawer frame and secured to said drawer plate so as to be positioned apart from one another and extend substantially perpendicularly away from one side of said drawer plate, said plurality of cylindrical magnets being adapted to be inserted through said plurality of openings in said outer face plate of said drawer frame into said housing when said drawer frame is inserted into said housing, whereby said gasket provides an air tight seal between said drawer frame and said housing when said device is assembled, said O-rings are operative to form a substantially air-tight seal about said plurality of magnets when said drawer frame is inserted into said housing, said plurality of magnets are adapted to retain tramp metal contaminants in the raw material passing through the housing when said drawer frame is inserted into said housing, and said drawer plate may be moved away from said face plate when said drawer frame is removed from said housing to move said plurality of magnets relative said face plate to remove tramp metal contaminants from said magnets.

11. The device of claim 10, wherein said magnets are at least partially formed from a ceramic material.

12. The device of claim 10, wherein said magnets are at least partially formed from a alnico material.

13. The device of claim 10, wherein said magnets are at least partially formed from a rare earth neodymium material.

14. The device of claim 10, wherein said face plate and said drawer plate are at least partially formed of a transparent material.

15. The device of claim 10, wherein said gasket is disposed in a groove in said housing.

16. The device of claim 10, wherein said gasket is disposed in a groove on said face plate.

* * * * *